US008382366B2

(12) United States Patent
Zaugg et al.

(10) Patent No.: US 8,382,366 B2
(45) Date of Patent: Feb. 26, 2013

(54) PROGRAMMABLE AND REPROGRAMMABLE MECHANICAL MEMORY WHEEL FOR A TIMEPIECE

(75) Inventors: Alain Zaugg, Le Brassus (CH); Olivier Karlen, Blonay (CH); Christophe Bifrare, Le Pont (CH)

(73) Assignee: Montres Breguet SA, L'Abbaye (CH)

( * ) Notice: Subject to any disclaimer, the term of this patent is extended or adjusted under 35 U.S.C. 154(b) by 161 days.

(21) Appl. No.: 13/034,070

(22) Filed: Feb. 24, 2011

(65) Prior Publication Data

US 2011/0205856 A1 Aug. 25, 2011

(30) Foreign Application Priority Data

Feb. 25, 2010 (EP) ..... 10154625

(51) Int. Cl.
*G04B 18/00* (2006.01)
*G04B 19/02* (2006.01)
*G04F 1/00* (2006.01)

(52) U.S. Cl. ..... 368/185; 368/34; 368/97; 368/101

(58) Field of Classification Search ..... 368/28, 368/31–37, 76, 80, 97, 101, 107, 185, 190, 368/198, 220, 269; 200/37 A, 38 R, 38 A, 200/38 B, 38 BA, 38 D
See application file for complete search history.

(56) References Cited

U.S. PATENT DOCUMENTS 2,058,712 A 10/1936 Muir et al.
2,325,539 A 7/1943 Pfister
2,789,410 A 4/1957 Bridevaux
3,811,019 A 5/1974 Solari
3,890,779 A 6/1975 Capt et al.
3,940,761 A 2/1976 Arai
5,285,427 A 2/1994 Vaucher
5,793,708 A * 8/1998 Schmidt et al. ..... 368/106
6,428,201 B1 * 8/2002 Shibuya et al. ..... 368/106
(Continued)

FOREIGN PATENT DOCUMENTS

CH 683 055 A5 1/1994
CH 685 965 A3 11/1995
(Continued)

OTHER PUBLICATIONS

Search Report issued in the corresponding European application EP 10 15 4625, completed Aug. 13, 2010.

(Continued)

*Primary Examiner* — Vit W Miska
(74) *Attorney, Agent, or Firm* — Griffin & Szipl, P.C.

(57) ABSTRACT

The invention concerns a programmable and reprogrammable mechanical memory wheel (30) for a timepiece, including a wheel (31) that is mobile about an axis of rotation (33).
It is wherein it includes a mobile heart-piece (40) which pivots relative to said wheel (31), between indexing positions (34) of said wheel (31) with which said heart-piece (40) is arranged to cooperate via an indexing finger (41) included therein and towards which said heart-piece is returned radially by resilient return means (43), and which includes at least one support surface (45) arranged for cooperating with a timepiece mechanism.
The invention also concerns a timepiece mechanism incorporating at least one memory wheel of this type (30), wherein, in proximity to each wheel (30), it includes support means arranged for cooperating with said support surface (45) of said memory wheel (30) in a disconnectable manner.

10 Claims, 1 Drawing Sheet

U.S. PATENT DOCUMENTS

| | | | | |
|---|---|---|---|---|
| 7,539,084 | B2 | 5/2009 | Berseth | |
| 2004/0037171 | A1* | 2/2004 | Meis | 368/110 |
| 2005/0249043 | A1* | 11/2005 | Bobe et al. | 368/101 |
| 2007/0002690 | A1 | 1/2007 | Rochat | |
| 2007/0091727 | A1* | 4/2007 | Bonvin et al. | 368/107 |
| 2008/0093435 | A1 | 4/2008 | Berseth | |
| 2008/0205200 | A1 | 8/2008 | Spode et al. | |
| 2009/0086583 | A1* | 4/2009 | Wyssbrod | 368/106 |
| 2009/0310445 | A1 | 12/2009 | Laucella et al. | |

FOREIGN PATENT DOCUMENTS

| | | | |
|---|---|---|---|
| CH | 693 155 | A5 | 3/2003 |
| CH | 693 292 | A5 | 5/2003 |
| EP | 0 570 856 | A1 | 11/1993 |
| EP | 1 306 734 | A2 | 5/2003 |
| EP | 1 873 696 | A1 | 1/2008 |
| EP | 1 959 317 | A1 | 8/2008 |
| EP | 2 136 271 | A1 | 12/2009 |
| FR | 2 158 532 | | 11/1972 |
| FR | 2 254 820 | | 7/1975 |
| WO | 2007/115984 | A2 | 10/2007 |

OTHER PUBLICATIONS

Office Action in co-pending related U.S. Appl. No. 13/035,057 on Nov. 9, 2012.

Notice of Alllowance issued on Dec. 11, 2012 in co-pending related U.S. Appl. No. 13/035,057.

* cited by examiner

PROGRAMMABLE AND REPROGRAMMABLE MECHANICAL MEMORY WHEEL FOR A TIMEPIECE

This application claims priority from European Patent Application No. 10154625.7 filed Feb. 25, 2010, the entire disclosure of which is incorporated herein by reference.

FIELD OF THE INVENTION

The present invention concerns a programmable and reprogrammable mechanical memory wheel for a timepiece.

The invention also concerns a timepiece mechanism incorporating this type of memory wheel.

The invention concerns the field of watchmaking, and more specifically timepiece mechanisms that can be integrated in watches.

STATE OF THE PRIOR ART

Mechanical memories in the form of perforated or machined discs or cards are known, for example including areas with teeth alternating with areas with no teeth, or even grooves or stop members of different lengths. These devices are perfectly reliable, but once made they are unalterable. The only way to alter the adjustment data that these mechanical memories contain is to change them completely and replace them with another similar support, including different adjustment data.

Devices with stop members or levers for changing position are also known, which generally only allow a restricted number of settings to be adjusted, and the reliability of which over time is not ideal.

Other systems with rotating drums, such as that disclosed in FR Patent No. 2 158 532 in the name of Solari & C, for changing the day indication and adjusting the date by increment, are adjusted with the insertion of combs which may or may not have teeth in different positions, but the use thereof requires pre-adjustment as for similar systems used on machine-tools, automatic lathes or suchlike, and these systems cannot be reprogrammed in the mechanism in which they are incorporated. In a similar but simplified manner, a device is known from FR Patent No 2 254 820 in the name of the Copal Company Ltd, which incorporates several memory wheels cooperating with each other and fitted with cams or cam portions.

There is also known from CH Patent No 693 292 in the name of Antonia Dolcet Cavero, a perpetual calendar mechanism which, in a timepiece application, integrates memory wheels, which include a certain number of cut out portions on the external or internal periphery of a disc or a ring, which have variable widths and depths and correspond, for example, on a day of the month wheel, to changes in the tens of days and to the 29th, 30th, 31st days of the month. Some of these cut out portions, particularly the last one in the preceding example, which is wide and tiered, can be entirely or partially concealed by a mobile screen under the action of a cam or suchlike. However, the concealing mechanism is cumbersome, which means that only a few positions can be stored.

CH Patent No 693 155 in the name of STREHLER Andreas discloses a switchable display mechanism for displaying two different pieces of information with the same hand. A heart-piece integral with a planet wheel holder for a planetary gear is provided for analogically storing the difference between the values of the two pieces of information. A first input of this planetary gear is connected to the hand; the second input is driven in order to represent the value of the second piece of information. The position of the planet wheel holder, at the exit of the differential gear, represents the difference between the values of the two pieces of information. When the display mechanism is switched to the second piece of information, the kinematic link between the first piece of information and the hand is uncoupled and a hammer is simultaneously lowered against the heart-piece to cause it to pivot with the planet wheel holder into a zero angular position, the second display is maintained as long as the hammer is abutting against said wheel. The movements of the second differential input wheel are then transmitted to the hand whose position changes in accordance with the value of the second piece of information. A second heart-piece with a second hammer forms the link that can be uncoupled between the first piece of information and the hand. This device is complex and expensive for handling time zones between which the time difference does not vary over time.

WO Patent No 2007/115984 in the name of FREDERIC PIGUET, SA is also known, which discloses a mechanism for storing a time difference between two time zones, and switching display means to indicate the time in one or other of these time zones. This mechanism includes a heart-piece that is mobile in rotation and linked to time display means via a kinematic chain, and cooperates selectively with one or other of two levers each corresponding to the display of one of the time zones, the switching is manual, and the time difference between the time zones is determined by the relative position of one lever with respect to the other. The hear-piece is asymmetrical, and it completes one revolution in 48 hours. Control means are provided for adjusting the time difference between the time zones by altering the position of at least one of the levers around the heart-piece.

In short, few purely mechanical solutions exist which are well suited to the problem, not only of data storage, but also of reprogramming a device by selecting a stored setting, or by creating a new setting, within the compact space available in a timepiece mechanism. The problem is all the more acute when a certain quantity of settings are provided, which is common in a timepiece where it is desired to adjust discrete settings, such as the days of the month, the months of the year, time zones, astronomic or zodiacal phases, for example.

SUMMARY OF THE INVENTION

The invention sets out to solve the problem of making a programmable mechanical memory that can be reprogrammed by the user, and particularly by the final user of a timepiece movement, such as the person wearing a watch. In short, it is a matter of being able to store easily adjustments performed by the user, in a very reliable and accurate manner.

The present invention therefore concerns a programmable and reprogrammable mechanical memory wheel for a timepiece mechanism, including a wheel that is mobile about an axis of rotation, wherein it includes a mobile heart-piece that pivots relative to said wheel, between indexing positions of said wheel with which said heart-piece is arranged to cooperate via an indexing finger that it includes and towards which it is returned radially by resilient return means, said heart-piece including at least one support surface arranged for cooperating with a mechanism that incorporates said memory wheel.

The invention also concerns a timepiece mechanism incorporating at least one memory wheel of this type, wherein, in proximity to each of said wheels, it includes support means arranged for cooperating with said support surface of said memory wheel such that it can be uncoupled therefrom.

In an advantageous and innovative manner, the invention allows storage of as many settings as there are indexing positions on a timepiece mechanism wheel, which can be achieved by cutting or milling in accordance with proven technologies, and makes the active setting available for use at any given time via the cooperation of the heart-piece with the timepiece mechanism. This same cooperation also enables the programming to be altered by forcibly shifting the indexing finger from one indexing position to another, against the resilient return means.

DESCRIPTION OF THE DRAWINGS

Other features and advantages of the present invention will appear more clearly from the following detailed description of one embodiment of the invention, this example being given solely by way of non-limiting illustration with reference to the annexed drawing, in which.

DETAILED DESCRIPTION OF THE INVENTION

Figure 1:
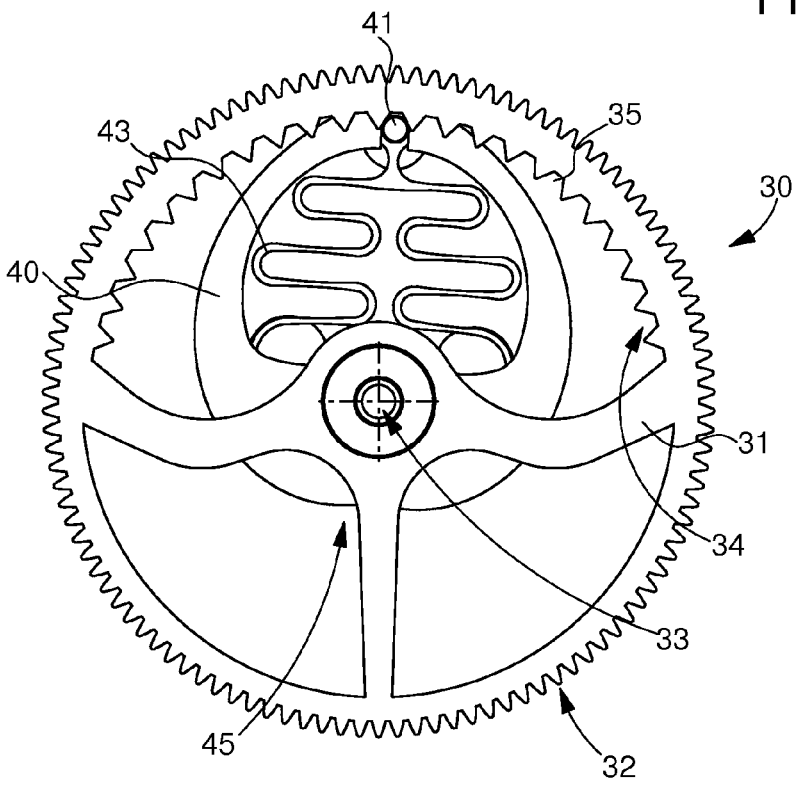
FIG. 1 shows schematically in a plan view, a memory wheel according to the invention, in a first embodiment.

The present invention concerns a timepiece mechanism arranged for storing settings selected by a user.

According to the invention, this mechanism is based on the use of at least one programmable and reprogrammable mechanical memory wheel, which forms a physical medium for the mechanical storage of a particular setting.

This memory wheel 30 for a timepiece mechanism includes a wheel 31 mobile about an axis of rotation 33, and including means for driving in rotation 36.

In a preferred but not exclusive embodiment, visible in the Figures, this wheel 31 is toothed and includes a toothing 32, which forms the means for driving in rotation 36. In the particular application of the Figures, this toothing 32 is external, but the invention is applicable in the same manner if toothing 32 is internal, or even bell shaped or other.

The invention is also applicable, without departing from the spirit and essential features thereof, to a wheel that is not toothed, but which includes other drive means 36, such as a pulley, which includes a groove or suchlike for supporting a drive belt, or a chain, or suchlike, or a wheel fitted with spikes or suchlike, or a wheel including a friction surface for the driving thereof.

According to the invention, memory wheel 30 includes a heart-piece 40, which moves by pivoting relative to wheel 31, preferably about axis of rotation 33, between indexing positions 34 of wheel 31. Heart-piece 40 includes indexing means 46, particularly an indexing finger 41, via which it can cooperate with the indexing positions, one at a time. This indexing finger 41, made in particular in the form of a pin 42, as visible in the Figure, is returned radially by resilient return means 43, particularly by a spring 44, towards indexing positions 34.

It is clear that, depending upon the particular case, the resilient return means 43 can work in compression, as in the example shown, or in traction.

Heart-piece 40 includes at least one support surface 45, which is arranged for cooperating with a complementary surface of a mechanism incorporating memory wheel 30. Preferably, support surface 45 matches, in a section of heart-piece 40, which is either substantially plane and substantially perpendicular to a radial line coming from axis of rotation 33 as visible in the first variant of FIG. 1, or has a substantially symmetrical female V groove relative to said radial line in the second variant of FIG. 2, the part of the peripheral surface of heart-piece 40 that is the closest to axis of rotation 43. Naturally, support surface 45 can take other concave or convex shapes and in particular profiles that can cause the heart-piece to pivot, when the mechanism incorporating the memory wheel includes complementary means capable of performing a drive function, such as a male V groove for example in FIG. 2.

Figure 2:
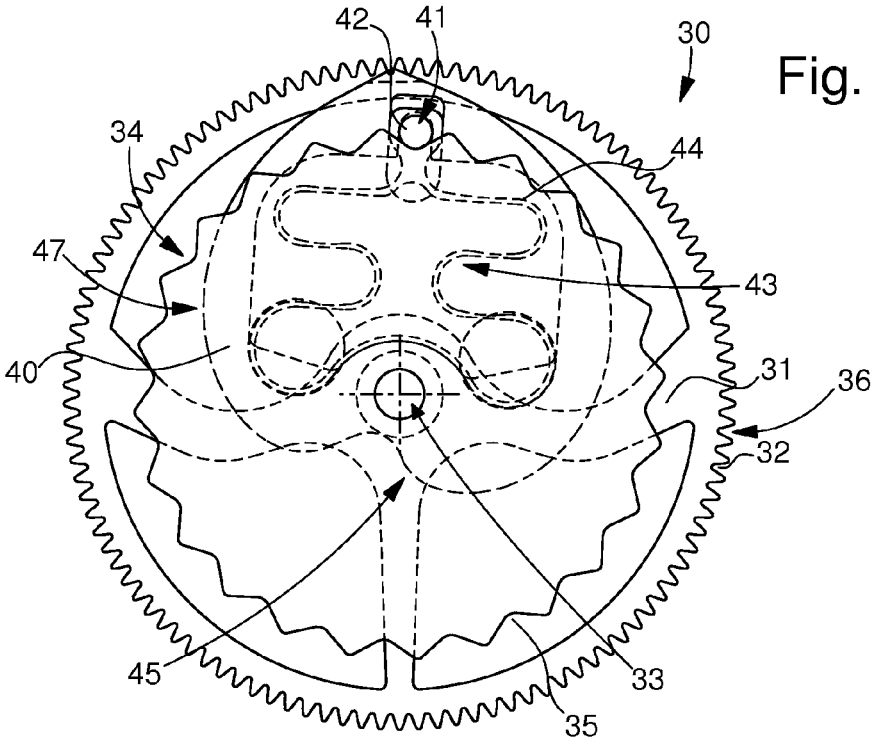
FIG. 2 shows schematically and in a plan view, a memory wheel according to the invention, in a second embodiment, and in a variant showing a support surface included therein.

The remainder of periphery 47 of heart-piece 40 advantageously has an ovoid or cardioid cam profile, and it is not necessarily symmetrical as can be seen in FIG. 2.

Preferably, the indexing positions 34 are formed by notches 35 distributed over a sector centred on axis of rotation 33.

In an alternative embodiment, indexing positions 34 are distributed over a complete circle.

In a particular first embodiment visible in FIG. 1, notches 35 are open towards axis of rotation 33.

In a second embodiment visible in FIG. 2, notches 35 are conversely open towards the periphery of wheel 31. It is clear in fact that, to reduce manufacturing costs, it may be advantageous to make only external cuts, for a toothing 32 and for indexing notches 35. Wheel 31 is then advantageously tiered.

Notches 35 are preferably equidistant.

Notches 35 are described with slopes or shelving on either side of a central hollow part forming the receptacle for indexing finger 41. Thus, the latter can slide or roll from one notch to another, under the effect of tangential force applied by wheel 31, provided that the radial component of the reaction of the wall of notch 35 to this force is greater than and in the opposite direction to the centrifugal or centripetal return force, depending upon the circumstances, exerted by spring 44.

It is clear that the mechanical memory achieved by positioning indexing finger 41 in a particular notch 35 can easily be reprogrammed, since finger 41 only needs to be moved towards another notch 35 to store another setting, as will be explained below.

It is, hence, possible to devise a timepiece mechanism incorporating at least one memory wheel 30 of this type. Preferably, according to the invention, this timepiece mechanism includes support means arranged for cooperating, in a disconnectable manner, with support surface 45 of each memory wheel 30 comprised in the timepiece mechanism.

Depending upon the circumstances, support means are specific to each memory wheel 30, or support means can serve several memory wheels 30, or all of memory wheels included in the timepiece mechanism concerned. The limit on the number of memory wheels is set by the space available in the case of the timepiece mechanism and by the desired functions.

What is claimed is:

1. A programmable and reprogrammable mechanical memory wheel for a timepiece mechanism, including a wheel that is mobile about an axis of rotation, wherein it includes a mobile heart-piece that pivots relative to said wheel, between indexing positions of said wheel with which said heart-piece is arranged to cooperate via an indexing finger included therein and towards which said heart-piece is returned radially by resilient return means, said heart-piece including at least one support surface arranged for cooperating with a mechanism that incorporates said memory wheel.

2. The memory wheel according to claim 1, wherein said wheel includes an external toothing.

3. The memory wheel according to claim 1, wherein said support surface is substantially perpendicular to a radial line coming from said axis of rotation.

4. The memory wheel according to claim 1, wherein said indexing positions are formed by notches distributed over a sector centred on said axis of rotation.

5. The memory wheel according to claim 1, wherein said indexing positions are formed by notches distributed over a complete circle.

6. The memory wheel according to claim 1, wherein said indexing positions are formed by notches open towards said axis of rotation.

7. The memory wheel according to claim 1, wherein said indexing positions are formed by notches open towards the periphery of said wheel.

8. The memory wheel according to claim 1, wherein said indexing positions are formed by equidistant notches.

9. The memory wheel according to claim 1, wherein said heart-piece pivots about said axis of rotation.

10. Timepiece mechanism incorporating at least one memory wheel according to claim 1, wherein, in proximity to each of said wheels, it includes support means arranged for cooperating, in a disconnectable manner, with said support surface of said memory wheel.

* * * * *